United States Patent [19]

Geringer et al.

[11] Patent Number: 4,623,181

[45] Date of Patent: Nov. 18, 1986

[54] ENTRY CLOSURE ASSEMBLY

[76] Inventors: Arthur V. Geringer, 4611 Deseret Dr., Woodland Hills, Calif. 91364; Richard G. Geringer, 28834 Barragan St.; David A. Geringer, 5382 Cheseboro Rd., both of Agoura, Calif.

[21] Appl. No.: 730,569

[22] Filed: May 6, 1985

[51] Int. Cl.[4] ..... E05C 1/16

[52] U.S. Cl. ..... 292/336.3; 292/DIG. 61; 292/DIG. 62

[58] Field of Search ..... 292/144, 150, 146, 106, 292/207, 336.3, DIG. 17, DIG. 61, DIG. 62

[56] References Cited

U.S. PATENT DOCUMENTS

| | | | |
|---|---|---|---|
| 1,126,181 | 1/1915 | Cleaver | 292/150 X |
| 2,003,394 | 6/1935 | Sell | 292/146 X |
| 2,106,955 | 2/1938 | Moffitt | 292/DIG. 17 X |
| 2,468,969 | 5/1949 | Galey | 292/144 |
| 2,765,648 | 10/1956 | Hatcher | 292/144 X |

*Primary Examiner*—Richard E. Moore
*Attorney, Agent, or Firm*—John J. Posta, Jr.

[57] ABSTRACT

The assembly includes a door with rotatable door handle connected thereto, and a primary door locking mechanism. The door is hinged for opening and closing in a frame disposed in an entry way. The door includes a handle hub lock having a hub locking plate around the handle hub, an elongated slide bolt supported to movement into and out of a recess in the locking plate and a bolt biasing mechanism. That biasing mechanism preferably includes a plunger extending from the leading door edge toward the door jamb and biasable thereby, during door closing, against the bolt to move it into the locked position, and one or more springs connected to the plunger. In one embodiment, one or more electromagnets selectively magnetically bias the slide bolt to the desired locked or unlocked position. The assembly is simple and effective.

14 Claims, 13 Drawing Figures

ENTRY CLOSURE ASSEMBLY

BACKGROUND OF THE INVENTION

1. Field of the Invention

The present invention generally relates to entry way closure assemblies and, more particularly, to such an assembly which includes a door, door frame, handle and closing mechanism and which has an improved type of door handle hub lock.

2. Prior Art

Security doors and the like generally include a variety of devices which operate to hold a security door shut in a frame and to automatically or selectively lock the door in the closed position. Certain security doors employ mechanisms to "freeze" the door handle against rotation in order to double lock the door in the closed position. One improved type of security door which employs a door handle lock is disclosed particularly in co-pending U.S. patent application Ser. No. 528,873, filed Sept. 1, 1983, now U.S. Pat. No. 4,596,411 issued June 24, 1986, of which Arthur Geringer, et al., is the inventor, said application being entitled "Locking and Monitoring Assembly" and the assignee of which is the assignee of the present application. That door employs a mechanism which has a plate secured around the handle hub within the door, and a slide bolt in the door, which bolt is levered into and out of locking position in a recess in the hub plate. Difficulties sometimes arise with that mechanism when the door handle is not initially in the full resting position and thus is not fully aligned to easily receive the slide bolt to lock the handle. In such a circumstance, the bolt tightly binds against the periphery of the plate and cannot seat in the recess so that the door handle is jammed, cannot be turned easily and remains unlocked, whether or not that fact is known, requiring the bolt movement activator to be backed off and the handle returned to full rest position before proper locking can be effected. Accordingly, there is a need for a new and improved entry way door closure assembly which can provide easy and positive door handle hub locking in a security door and the like, and which permits easy turning of the handle to the full rest position if it is misaligned with the lock bolt, so as to facilitate seating of the bolt in the hub plate recess and positive locking of the handle. The user should need to move the handle only slightly to verify that the handle is locked in place or is unlocked.

SUMMARY OF THE INVENTION

The improved entry closure assembly of the present invention satisfies all the foregoing needs. The assembly is substantially as set forth in the Abstract above. Thus, it includes a door hingedly or otherwise secured for movement between an open and a closed position in a door frame containing a door jamb. The assembly includes a primary door locking mechanism, such as a latch secured to the door extending into the jamb when the door is in the closed position and operable by suitable means to retract to allow the door to be opened. The door includes a door handle hub locking device having a hub locking plate with peripheral recess, and an elongated slide bolt supported for movement into and out of the recess to lock and unlock the handle against rotation. The hub locking device also includes novel biasing means connected to the slide bolt for biasing it into and out of the locked position.

In one embodiment, the slide bolt is magnetized and is biased by one or more magnets disposed adjacent the slide bolt to attract or repel it. In another embodiment the slide bolt is a permanent magnet and a reversible pole electromagnet is positioned to selectively magnetically attract and/or repel the slide bolt to effect its movement.

In a third embodiment a spring is connected to a plunger bearing against the slide bolt, with the plunger extending out of the leading edge of the door so that it is biased inwardly by the door jamb when the door is being closed.

In another embodiment, a return spring is connected to the slide bolt and the plunger spring may also be used to effect the desired slide bolt biasing. Various other features of the present invention are set forth in the following detailed description and accompanying drawings.

DRAWINGS

DETAILED DESCRIPTION

FIGS. 1-3

Figure 1:
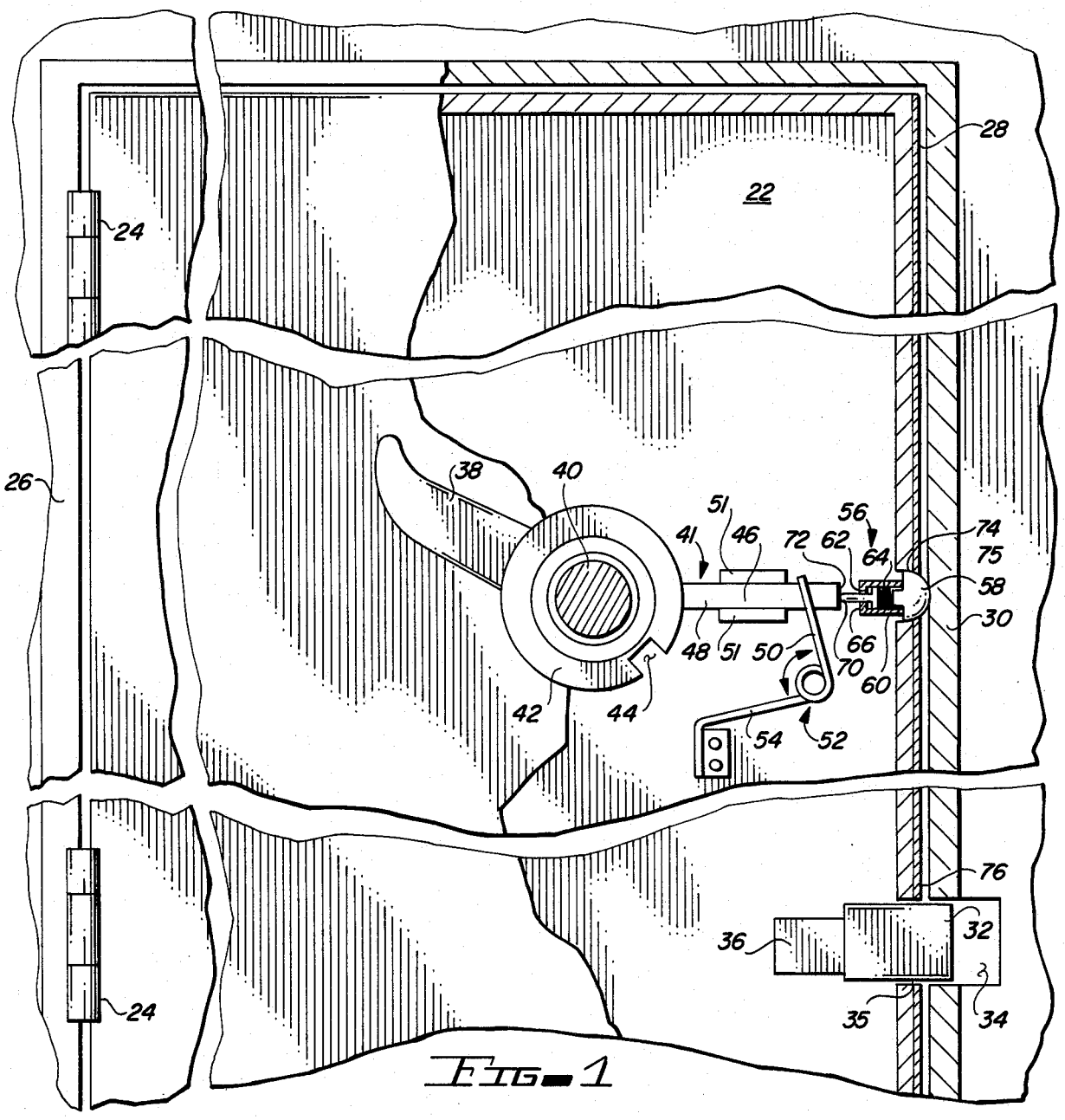
FIG. 1 is a schematic fragmentary side elevation, partly in section and partly broken away, illustrating a first preferred embodiment of the improved entry closure assembly of the present invention, shown in the door closed position with the door handle in the unlocked position.
Figure 2:
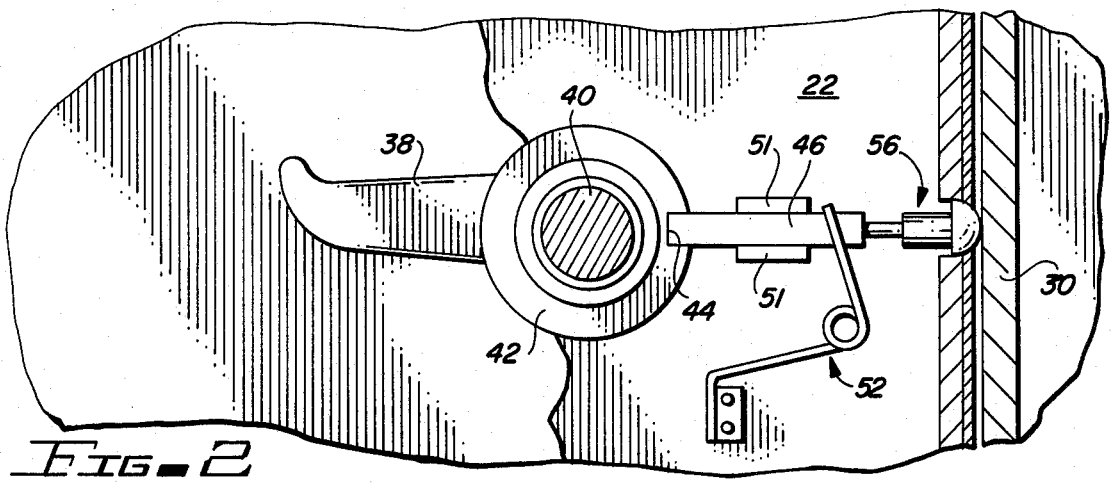
FIG. 2 is a schematic fragmentary side elevation, partly broken away and partly in section, of the door handle hub lock of FIG. 1 shown in the door closed handle locked position.
Figure 3:
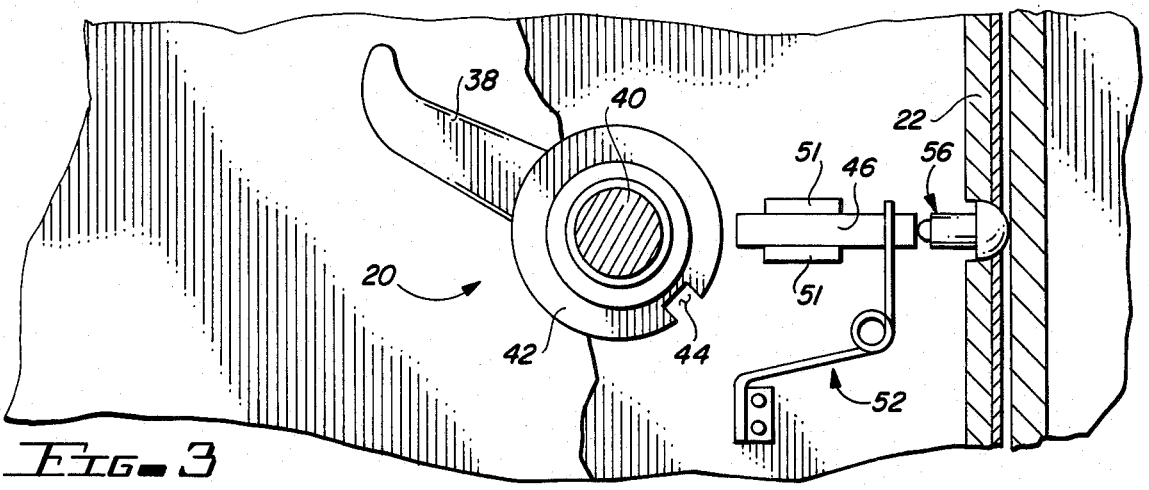
FIG. 3 is a schematic fragmentary side elevation, partly broken away and partly in section, of the door handle and hub lock shown in the door open handle unlocked position.

Now referring more particularly to FIGS. 1-3 of the drawings, a first preferred embodiment of the improved doorway closure assembly of the present invention is schematically depicted therein in fragmentary side elevation. Thus, assembly 20 is shown which includes a door 22 secured by hinges 24 to frame 26 defining an entry way 28. In FIG. 1, door 22 is shown closed against adjacent door jamb 30 of frame 26.

Assembly 20 may include a conventional primary locking mechanism, such as a latch 32 slideably bridging recess 34 of jamb 30 and recess 35 of door 22 in order to lock door 22 closed and retractable by a conventional mechanism generally designated 36, such as an electrically powered unit disposed in door 22 from one of those recesses in order to unlock door 22 or jamb 30. It will be understood that any number of comparable mechanisms can be employed.

Assembly 20 also includes a novel hub lock 41 in door 22 comprising a preferably curved hub plate 42 secured around hub 40 and defining therein a recess 44 extending inwardly from the periphery thereof. Lock 41 includes an elongated slide bolt 46, the inner end 48 of which is dimensioned to be received in recess 44. Bolt 46 is secured to and is held in an about horizontal position by the upper arm 50 of an L-shaped return spring 52 or the like, the other arm 54 of which is anchored to door 22, and guide members 51.

Lock 41 further includes a horizontal plunger 56 comprising an expanded rounded head 58 connected to a tubular shaft 60 having an internal space 62 bearing a coil spring 64 with the back 66 of a T-shaped impellar 68 bearing thereagainst and with the front tip 70 of impeller 68 bearing against rear end 72 of bolt 46. Head 58 is seated in opening 74 which has a narrowed front lip 75 to retain head 58. Opening 74 is in leading edge 76 of door 22.

When door 22 is in the open position away from jamb 30, head 58 protrudes part way out of opening 74 and springs 52 and 64 are in the relaxed position with bolt 46 out of recess 44 and with door handle unlocked (FIG. 3). However, when door 22 closes, jamb 30 biases head 58 into door 22, compressing spring 64 and causing impellar 68 to bias bolt 46 into contact with hub 40, against the spring action of return spring 52. If handle 38 is in the full resting position (FIG. 2), bolt 46 easily seats in recess 44 to lock handle 38 against rotation (FIG. 2). If, however, handle 38 is turned so that recess 44 is out of alignment with bolt 46 (FIG. 1), bolt 46 is spring biased against the periphery of plate 42 so that handle 38 can still be turned to the position of FIG. 2 to cause the biasing force to drive bolt 46 into recess 44 in order to hub lock handle 38. Accordingly, lock 41 has improved properties over conventional slide bolt locking mechanisms, including that employed in the assembly disclosed in copending U.S. application Ser. No. 528,873, referred to above.

Figure 4:
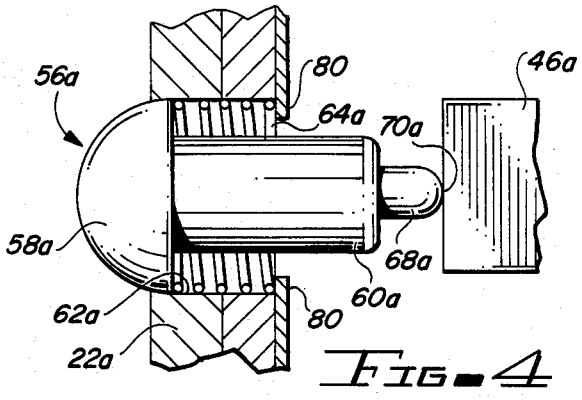
FIG. 4 is an enlarged schematic side elevation of a second preferred embodiment of the plunger and spring of the hub lock of the assembly of the present invention shown in the door open position.
Figure 5:
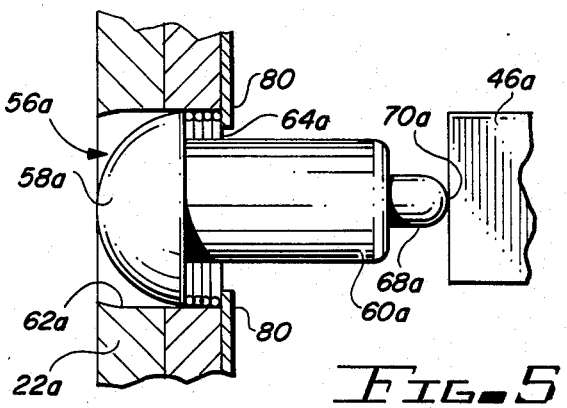
FIG. 5 is an enlarged schematic side elevation of the plunger and spring of FIG. 4, shown in the biased door-closed position.

FIGS. 4 and 5

A modified form of the plunger utilized in the embodiment of FIGS. 1-3 is shown schematically in FIGS. 4 and 5. Thus, plunger **56*a* is shown which is identical to plunger 56 except that spring 64*a* is peripheral and concentric of shaft 60*a* in space 62*a* and is held therein by head 58*a* and by detents 80 on the inner face of door 22*a*. Moreover, impeller 68*a* is merely a narrowed portion of shaft 60*a*. Accordingly, plunger 56*a* and detents 80 can be substituted for plunger 56**.

Figure 6:
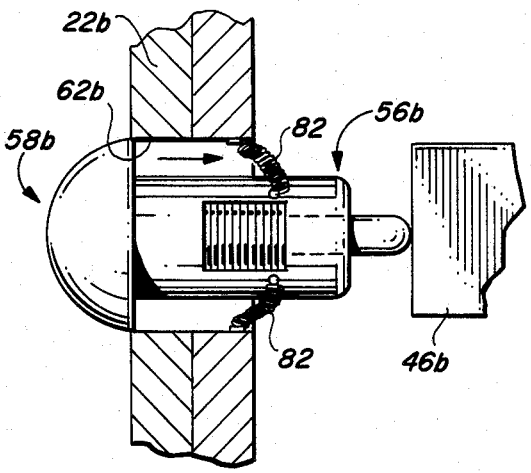
FIG. 6 is an enlarged schematic side elevation of a preferred embodiment of the plunger and spring of the hub lock of the assembly of the present invention, shown in the biased door-open position.
Figure 7:
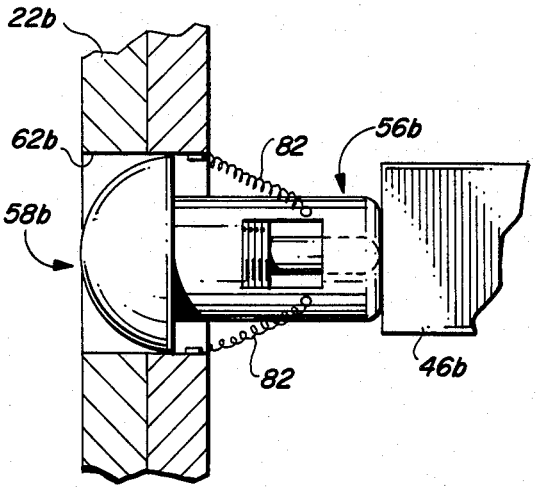
FIG. 7 is an enlarged schematic side elevation of the plunger and spring of FIG. 6, shown in the biased door-closed position.

FIGS. 6 and 7

A further modification of the plunger of the invention is schematically depicted in FIGS. 6 and 7. In this regard, plunger **56*b* is shown which is identical to plunger 56 except that it includes springs 82 connected to shaft 60*b* and to the inner face of door 22*b* adjacent space 62*b*, in order to limit protrusion of head 58*b* from space 62*b*, inasmuch as space 62*b* is cylindrical and has no outer, tapered head-retaining lip, as does space 62. Plunger 56*b* and cylindrical space 62*b* can be substituted for plunger 56 and space 62**.

FIGS. 8-10

Figure 8:
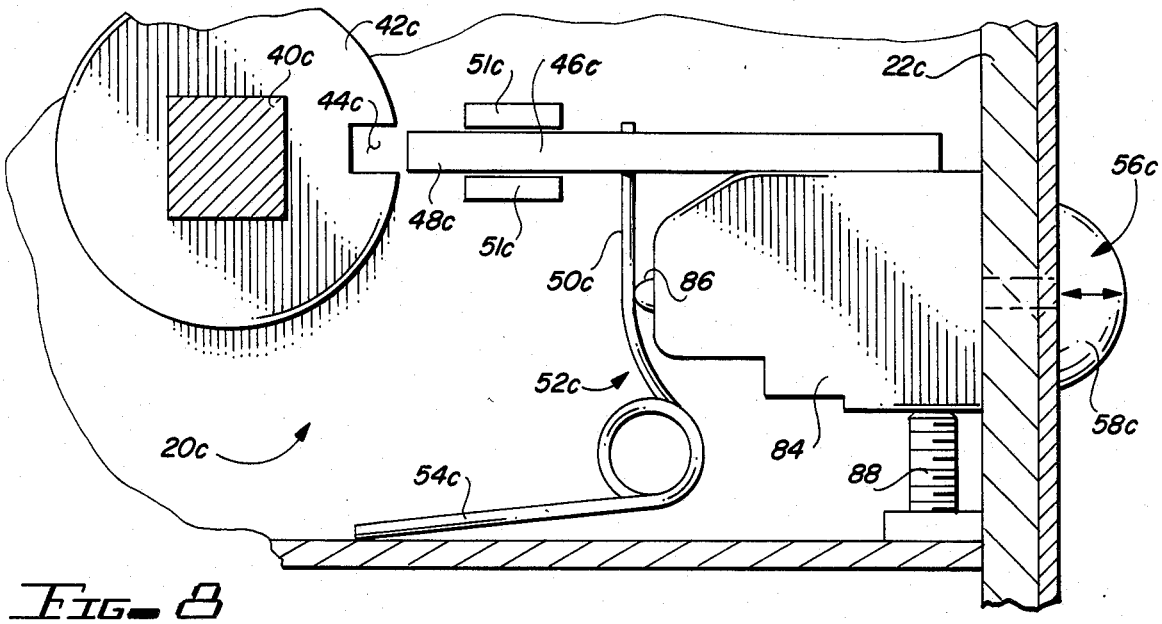
FIG. 8 is an enlarged schematic side elevation, partly in section, of a fourth preferred embodiment of the improved handle hub lock of the assembly of the present invention, shown in the door-open handle unlocked position.
Figure 9:
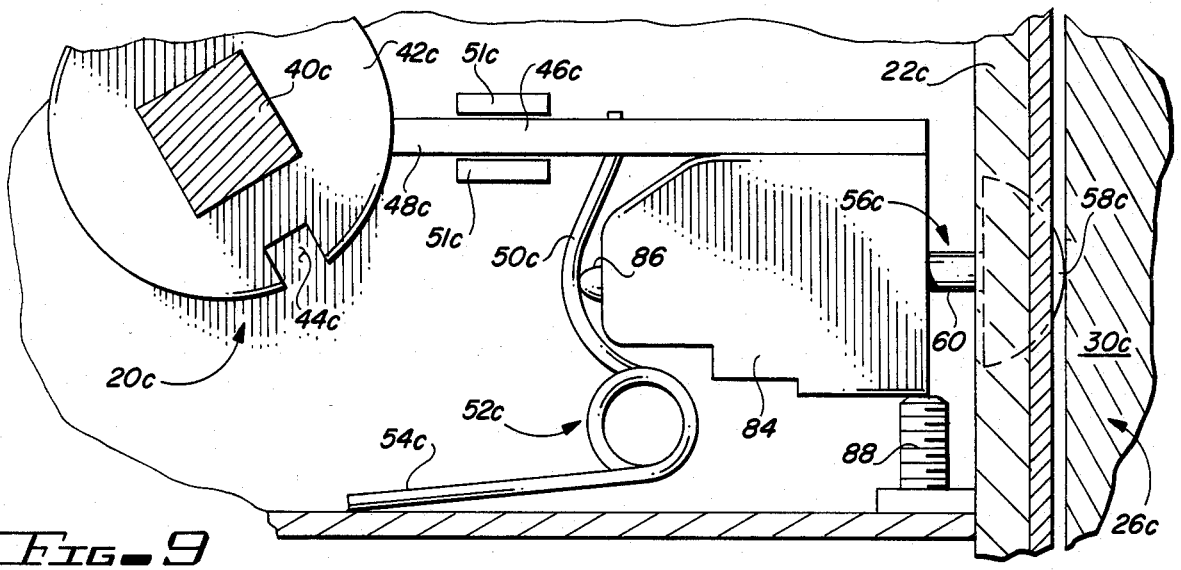
FIG. 9 is an enlarged schematic side elevation partly in section of the hub lock of FIG. 8, shown in the door-closed handle unlocked position.
Figure 10:
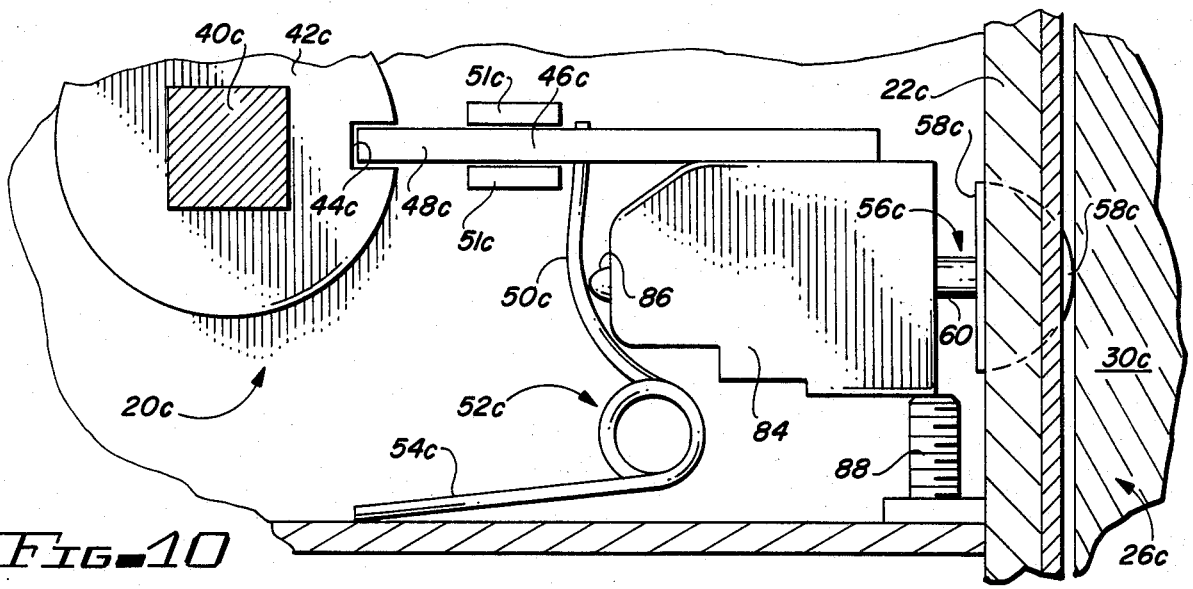
FIG. 10 is an enlarged schematic side elevation, partly in section, of the hub lock of FIG. 8, shown in the door-closed handle locked position.

Another embodiment of the improved assembly of the present invention is schematically depicted in FIGS. 8-10. Thus, assembly **20*c* is shown. Components thereof similar to those of assembly 20 bear the same numerals, but are succeeded by the letter "c". In this regard, assembly 20*c* includes door 22*c* in frame 26*c* defining entry way 28*c*. Door 22*c*, when closed, abuts jamb 30*c* so that jamb 30*c* biases head 58*c* of plunger 56*c* into door 22*c* (FIGS. 9 and 10**).

Plunger **56*c* includes shaft 60*c* connected to expanded body 84 having a pointed front tip 86. Body 84 is supported on stud 88 in door 22*c*. Return spring 52*c* is secured to slide bolt 46*c* and holds it by arm 50*c* in a horizontal position, while lower arm 54*c* of spring 52*c* anchors spring 52*c* in door 22*c*. Plate 42*c* is secured around hub 40*c* and contains recess 44*c* adapted to receive end 48*c* of bolt 46*c* to lock handle 38*c*** against movement.

Thus, in the resting position shown in FIG. 8, bolt **46*c* is out of recess 44*c* and handle 38*c* is unlocked. Head 58*c* protrudes from door 22*c* and door 22*c* is open and away from jamb 30*c*. However, when door 22*c* is closed (FIGS. 9 and 10) jamb 30*c* biases head 58*c* into door 22*c*, forcing tip 86 to shove bolt 46*c* towards plate 42*c* against the spring force of arm 50*c* which bows. If recess 44*c* is not aligned with bolt 46*c* (FIG. 9), the excess biasing force is taken up by arm 50*c*, allowing handle 38*c* to be turned to the position of FIG. 10; that is, until bolt 46*c* is driven into recess 44*c* to lock handle 38*c*. When door 22*c* is opened, spring 52*c* returns to its original position, bearing bolt 46*c* with it, causing bolt 46*c* to exit recess 44*c* thereby automatically unlocking handle 38*c*. Thus, a single spring (52*c***) is used to accomplish the above-indicated functions smoothly and efficiently.

FIG. 11

Figure 11:
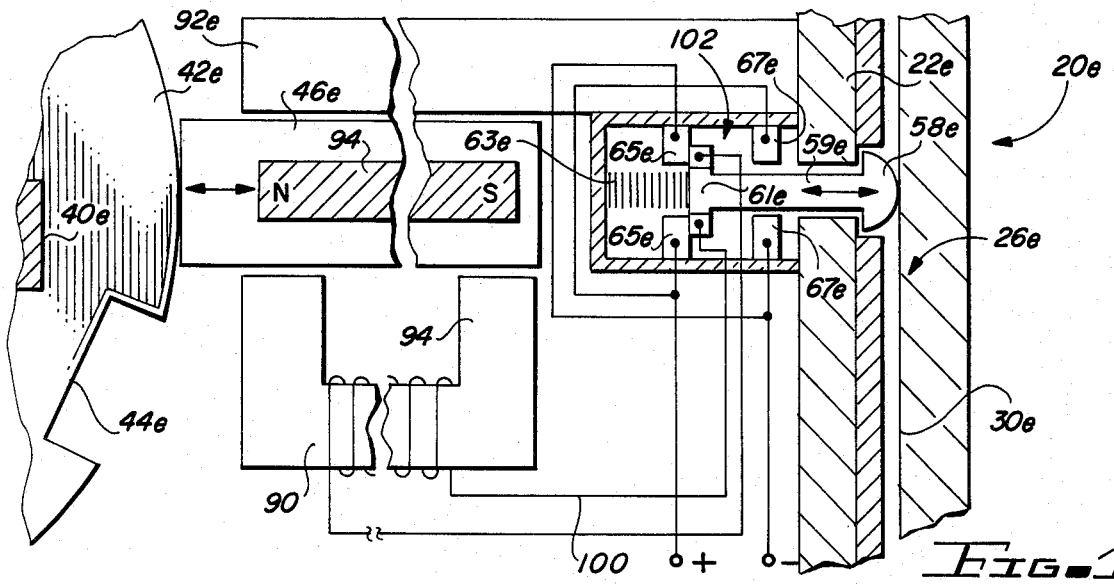
FIG. 11 is a schematic fragmentary side elevation, partly in section, of a Fifth preferred embodiment of the hub lock of the assembly of the present invention, shown in the handle unlocked position.
Figure 12:
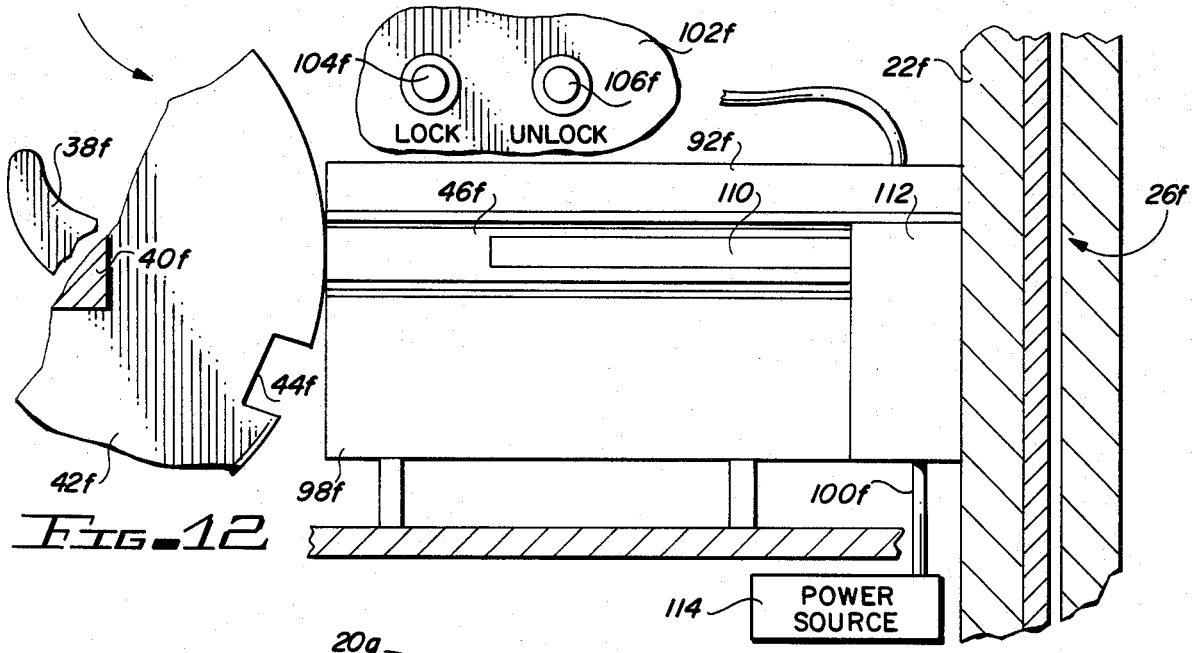
FIG. 12 is a schematic fragmentary side elevation, partly in section, of a Sixth preferred embodiment of the hub lock of the assembly of the present invention, shown in the handle unlocked position.

A further preferred embodiment of the present assembly is schematically depicted in FIGS. 11 and 12. Thus, assembly **20*e* is shown. Components thereof similar to those of any of assemblies 20, 20*a*, 20*b*, 20*c* or 20*d* bear the same numerals, but are succeeded by the letter "e". Assembly 20*e* includes door 22*e* in frame 26*e*, handle 38*e* with hub 40*e* and hub plate 42*e* bearing recess 44*e*. Slide bolt 46*e* is supported on stand 90*e* below guide 92*e* and bears a permanent magnet 94. Electromagnet 90 is provided adjacent magnet 94 and is connected to a power source (not shown) via electrical conductors 100** and also to a 2-way switch 102. Head 58e has a plunger portion 59e with a contact plate 61e at the opposite end thereof. Depression of head 58e against bias spring 63e causes plate 61e to bridge one set of contacts 65e to energize electromagnet 90 causing permanent magnet 94 and bolt 46e to be magnetically biased toward hub 40e. When recess 44e is aligned with bolt 46e, the bolt 46e will move into recess 44e to then prevent rotation of hub 40e.

When the door is opened, head 58e is moved outwards by spring 63e, thereby having plate 61e bridge contacts 67e, causing the polarity of electromagnet 90 to be reversed and thereby biasing bolt 46e out of recess 44e, thereby unlocking handle 38e.

FIG. 12

A still further embodiment of the improved assembly of the invention is schematically depicted in FIG. 12. Thus, assembly 20f is shown. Components thereof similar to any of those of assemblies 20–20e bear the same numerals, but are succeeded by the letter "f". Assembly 20f includes door 22f in frame 26f, with handle 38f containing hub 40f and hub plate 42f with recess 44f. Slide bolt 46f is supported on stand 98f below guide 92f.

Bolt 46f contains a permanent magnet 110 at the outer end thereof and an electromagnet 112 is secured to stand 90f and shuts magnet 110. Electromagnet 112 is reversible in poles and is powered by a power source 114 through connectors 100f running to control board 102f containing lock button 104f and unlock button 106f. By causing electromagnet 112 to selectively repel or attract magnet 110 (by operation of control board 102f), bolt 46f is caused to lock handle 38f by sliding into recess 44f or unlock handle 38f by moving out of recess 44f. Accordingly, assembly 20f is similar to assembly 20e in functions and properties.

FIG. 13

Figure 13:
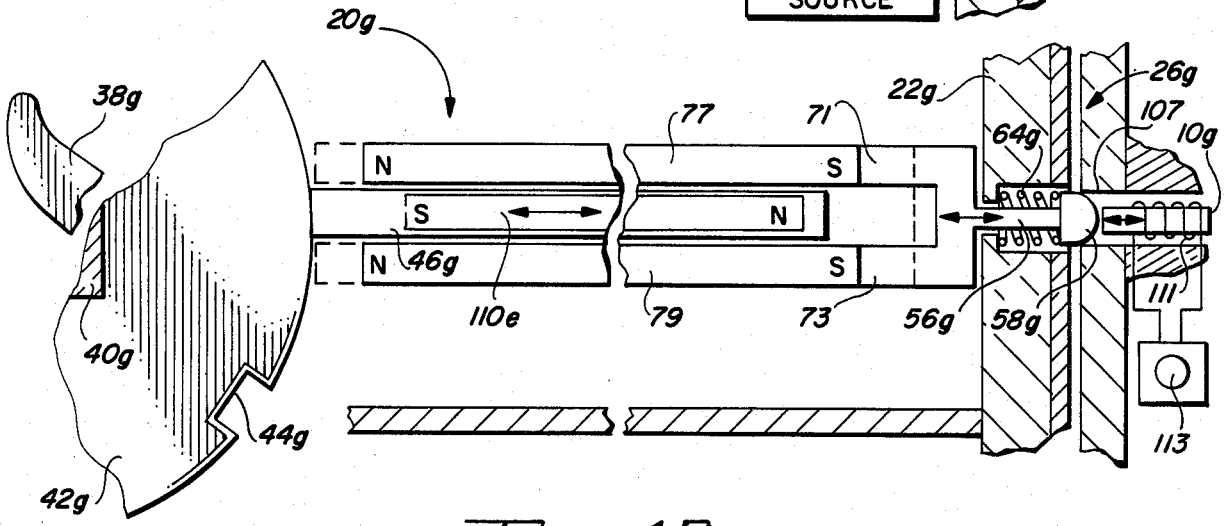
FIG. 13 is a schematic fragmentary side elevation, partly in section, of a Seventh preferred embodiment of the hub of the assembly of the present invention, shown in the handle unlocked position.

Yet another embodiment of the invention is schematically depicted in FIG. 13, thus assembly 20g is shown. Components thereof similar to any of those of assemblies 20–20f bear the same numerals, but are succeeded by the letter "g". Assembly 20g includes door 22g in frame 26g, with handle 38g hub 40g and hub plate 42g with recess 44g. Slide bolt 46g contains a permanent magnet 110e. Head 58g is biased outwards from the door 22g by spring 64g. The opposite end of plunger 56g terminates in a U-shaped extension having arms 71 and 73 to which are attached permanent magnets 77 and 79. Door jamb 26g has an opening 107 adapted to receive head 56g when it is disposed opposite said head 56g. An armature 109 is slideably disposed in opening 107 and is actuated by solenoid 111 which is connected to solenoid energizing means 113, which in connected to a suitable source of power (not shown).

When door 22g is in the open position, away from jamb 26g, head 58g is biased outwards from door 22g, and spring 64g is in a relaxed position with bolt 46g out of recess 44g.

However, as door 22g is closing, jamb 26g biases head 58g into door 22g, compressing spring 64g and causing magnets 77 and 79 to assume the position shown in dotted lines, while attempting, by magnetic force, to carry bolt 46g with them. If recess 44g is not aligned with the bolt, 46g, bolt 46g will abut plate 42g but will not be displaced.

When head 58g is aligned with opening 107, magnets 77 and 79 will assume their original position and the magnet biasing force on bolt 46g to move into recess 44g will be removed.

If recess 44g were in alignment with bolt 46g, and the door 22g closed with head 58g being disposed in opening 107, applicant's assembly shown in FIG. 13 would allow an operator to selectively move bolt 46g into and out of recess 44g to lock or unlock handle 38g. This can be readily accomplished by actuating solenoid 111 via actuator means 113, which causes armature 109 to pursh head and arms 77, 79 towards plate 42g, and when bolt 46g and recess 44g are in alignment, bolt 46g will enter recess 44g and prevent rotation of hub 40g so long as solenoid 109 is activated. Upon deactivation of solenoid 109, spring 64g will move head 58g out of door 22g into opening 107, thereby bolt 46g to move out of recess 44g.

It might be noted that it would be quite obvious to use the armature 109, solenoid 111 and actuator 113 assembly in any of the other embodiments disclosed in the specification by simply modifying the door frame 26g.

Various other modifications, changes, alterations and additions can be made in the improved closure assembly of the present invention, its components and their parameters. All such modifications, changes, alterations and additions as are within the scope of the appended claims form part of the present invention.

What is claimed is:

1. An improved entry closure assembly, said assembly comprising, in combination:

(a) a door frame including a door jamb disposed in an entry way;

(b) a door secured to said frame for movement between open and closed entry way positions;

(c) primary door opening and closing means disposed in said door and said door jamb;

(d) a door handle hub rotatably secured to said door and operatively connected to said door opening and closing means; and, (e) door handle hub locking means comprising (i) a locking plate secured around said door handle hub in said door, said plate defining a slide bolt-receiving recess in the outer periphery thereof, (ii) an elongated slide bolt adapted to be received in said recess and disposed in said door between said door handle hub and the portion of said door jamb adjacent to said hub, (iii) support means in said door connected to said slide bolt for holding said slide bolt and permitting movement of said slide bolt between a first unlocked hub position, in which position said bolt lies outside said recess in said plate, and a second handle hub-locking position, in which latter position said bolt lies inside said recess in said plate, and, (iiii) biasing means in said door connected to said slide bolt for biasing said slide bolt into said locked and said unlocked positions.

2. The improved entry closure assembly of claim 1 wherein said slide bolt biasing means includes a plunger in said door secured to the outer end of said slide bolt and adapted to extend outwardly from the leading edge of said door toward said door jamb and biasable into said door during closing of said door, by contact with said door jamb.

3. The improved entry closure assembly of claim 2 wherein said biasing means includes spring biasing means connected in said door to at least one of said plunger and said slide bolt and adapted to resiliently bias said slide bolt against said hub plate and into said recess during said closing of said door and out of said recess into said unlocked position during opening of said door.

4. The improved entry closure assembly of claim 3 wherein said plunger includes an enlarged head disposed in an opening in said door leading edge and a shaft secured to said head and abutting the outer end of said slide bolt, and wherein a spring is positioned against said plunger in said door to resiliently cushion at least one of said plunger head and shaft during biasing of said plunger toward said slide bolt.

5. The improved entry closure assembly of claim 4 wherein said plunger spring is disposed in a cavity in a tubular portion of said plunger, said spring being disposed between said head and said shaft.

6. The improved entry closure assembly of claim 4 wherein said plunger spring is disposed around said shaft and held in said opening between said head and a detent secured to said opening.

7. The improved entry closure assembly of claim 3 wherein said spring is secured to said slide bolt in front of said plunger shaft so that said shaft bears thereagainst and flexes said spring during closing of said door.

8. The improved entry closure assembly of claim 3 wherein said spring is secured to said door and supports said slide bolt for operative movement, said spring being flexed during closing of said door.

9. The improved entry closure assembly of claim 4 wherein a second spring is secured directly to said slide bolt and supports said slide bolt, said second spring being flexed during closing of said door.

10. The improved entry closure assembly of claim 1 wherein said slide bolt support means comprises guide means, and wherein said slide bolt is magnetically attractable and wherein said biasing means comprises at least one electromagnet, a power source, controls means and electrical circuitry interconnecting said electromagnet, power source and control means for operation of said electromagnet to move said slide bolt by magnetic force between said locked and unlocked positions in response to operation of said control means.

11. The improved entry closure assembly of claim 1 wherein said slide bolt includes a permanent magnet, wherein said electromagnet is aligned in said door therewith to selectively alternately repel and attract said slide bolt magnet, thereby effecting said locking and unlocking of said door handle hub.

12. The improved entry closure assembly of claim 11 wherein said electromagnet is wired to selectively reverse its poles for said repelling and attracting of said slide bolt magnet.

13. The improved entry closure assembly of claim 1 wherein said slide bolt includes a permanent magnet and wherein said biasing means includes at least one permanent magnet disposed adjacent the permanent magnet on the slide bolt.

14. The improved entry closure assembly of claim 1 including means disposed within said door jamb to selectively bias said bolt into a locked or unlocked position.

* * * * *